United States Patent [19]

Goutiere

[11] Patent Number: 5,007,888

[45] Date of Patent: Apr. 16, 1991

[54] ELECTRICAL INTERCONNECTION ASSEMBLY

[75] Inventor: Alain Goutiere, Cergy Saint Christophe, France

[73] Assignee: AMP Incorporated, Harrisburg, Pa.

[21] Appl. No.: 493,027

[22] Filed: Mar. 13, 1990

[30] Foreign Application Priority Data

Mar. 13, 1989 [FR] France ..... 89 03251

[51] Int. Cl.[5] ..... H01R 29/00

[52] U.S. Cl. ..... 439/189; 439/49; 439/507; 439/510; 439/511

[58] Field of Search ..... 439/49, 189, 507, 511, 439/512, 518, 889

[56] References Cited

U.S. PATENT DOCUMENTS 3,087,137 4/1963 Linn ..... 439/507
3,656,091 4/1972 Anhalt et al. ..... 439/49
4,487,464 12/1984 Kirschenbaum ..... 339/19
4,895,532 1/1990 Bogese, II ..... 439/507

*Primary Examiner*—Paula A. Bradley
*Attorney, Agent, or Firm*—William B. Noll

[57] ABSTRACT

This invention is directed to an electrical interconnection assembly, such as a bulkhead interconnect for an automobile or truck. For such preferred use, the assembly hereof is located in the bulkhead or fire wall to connect the electrical systems on the engine side with switches and/or indicators on the cabin side. The assembly comprises a housing (10) having an array of electrical contacts (30) therein, where said contacts (30) are arranged for exposure to opposed openings (70) in said housing to allow for the above mentioned electrical connection to be made. In its preferred embodiment, the contacts (30) are elongated contact members (30) having male tabs (32) at each end thereof and disposed in parallel relationship with said housing (10). Further, means (50,52,54,72) are provided for electrically engaging certain adjacent elongated contact members (30).

2 Claims, 4 Drawing Sheets

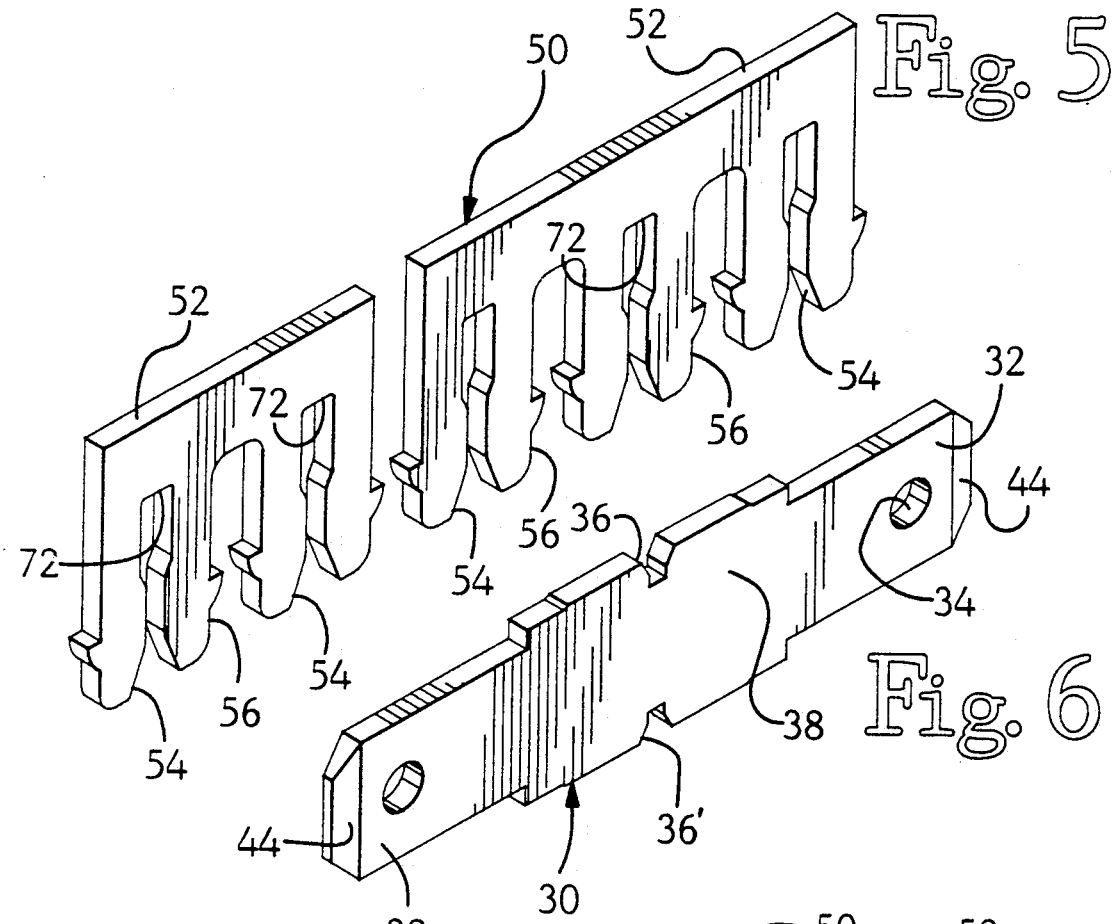
Fig. 5
Fig. 6
50
52
72
54
56
32
44
36
34
38
36'
30
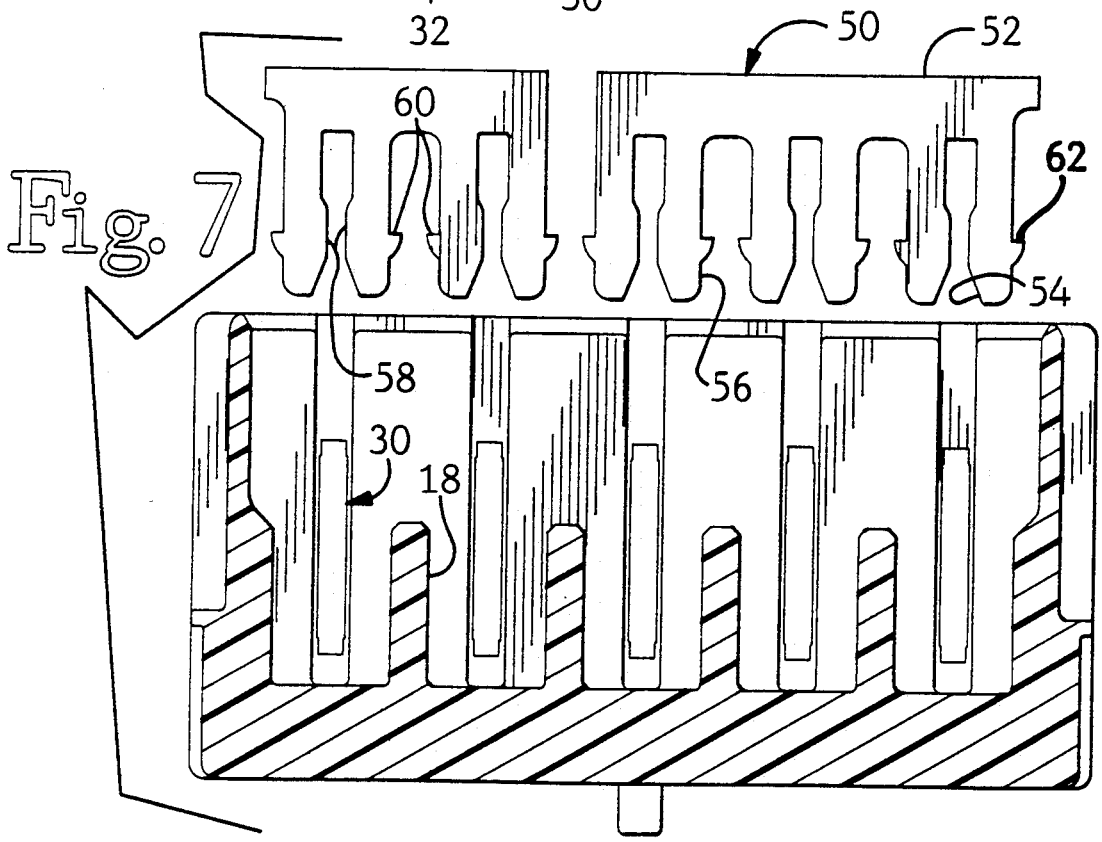
Fig. 7
50
52
60
62
54
58
56
30
18

ELECTRICAL INTERCONNECTION ASSEMBLY

BACKGROUND OF THE INVENTION

The present invention is directed to an electrical interconnection assembly, more particularly a bulkhead interconnect connector for automobiles and trucks. Such a connector is mounted in a bulkhead or wall, with mating components mounted on either side of the connector. A purpose thereof is to provide electrical interconnection between various electrical circuits on the engine side with switches, indicators or the like on the cabin side.

Other and more sophisticated bulkhead connectors require the use of interfacial seals to prevent the entry of moisture or condensing of moisture on the mating face of the connector which may cause electrical failure between the contacts. Whether simple or complex, typical bulkhead assemblies include a shell or tubular member suitable for installation in a wall opening, a plurality of contacts or conductors arranged parallel to the axis of the shell, and means for supporting such contacts within the shell. From opposing ends of the shell, complementary connectors or plugs may be joined therewith in electrical engagement with said contacts.

SUMMARY OF THE INVENTION

The present invention utilizes certain of such typical features, but offers a significant advantage over other known devices. The invention hereof gives added versatility to the assembly by means which allow the user thereof to offer numerous programming possibilities. Specifically, by means to be more fully described hereinafter, the unique features of this assembly are achieved by the selective use of electrically conductive transverse members to electrically interconnect two or more parallel and adjacent contacts. In an exemplary assembly of ten parallel contacts, four transverse members to join such conductors in the relationship of 3-2-2-3. Clearly other combinations, such as 2-3-1-1-1-3, may be selected as desired.

The various programming possibilities of this invention are found in an electrical interconnection assembly comprising a housing composed of a top, bottom, and a pair of side walls joined thereto and having an array of electrical contacts therein, where said contacts are arranged for exposure to opposed openings in said housing. The contacts comprise elongated planar members having male tabs at each end thereof and disposed in parallel relationship within said housing. Means in the form of plural transverse members are provided for electrically engaging certain adjacent elongated planar members. Such members are supported within the housing in openings laterally arranged along a central wall therein. Further, such transverse members access the housing by means of a slot provided laterally of the top in communication with said central wall.

BRIEF DESCRIPTION OF DRAWING

FIG. 5 is a perspective view of a two-piece lateral or transverse member suitable for use in the assembly hereof.

FIG. 6 is a perspective view of an elongated planar contact, without the side embossing as shown in FIG. 1, for insertion into the housing assembly of this invention.

FIG. 7 is a lateral sectional view of the housing assembly of FIG. 1 illustrating the pre-insertion position of the two-piece transverse member of FIG. 5.

DETAILED DESCRIPTION OF PREFERRED EMBODIMENT

Figure 1:
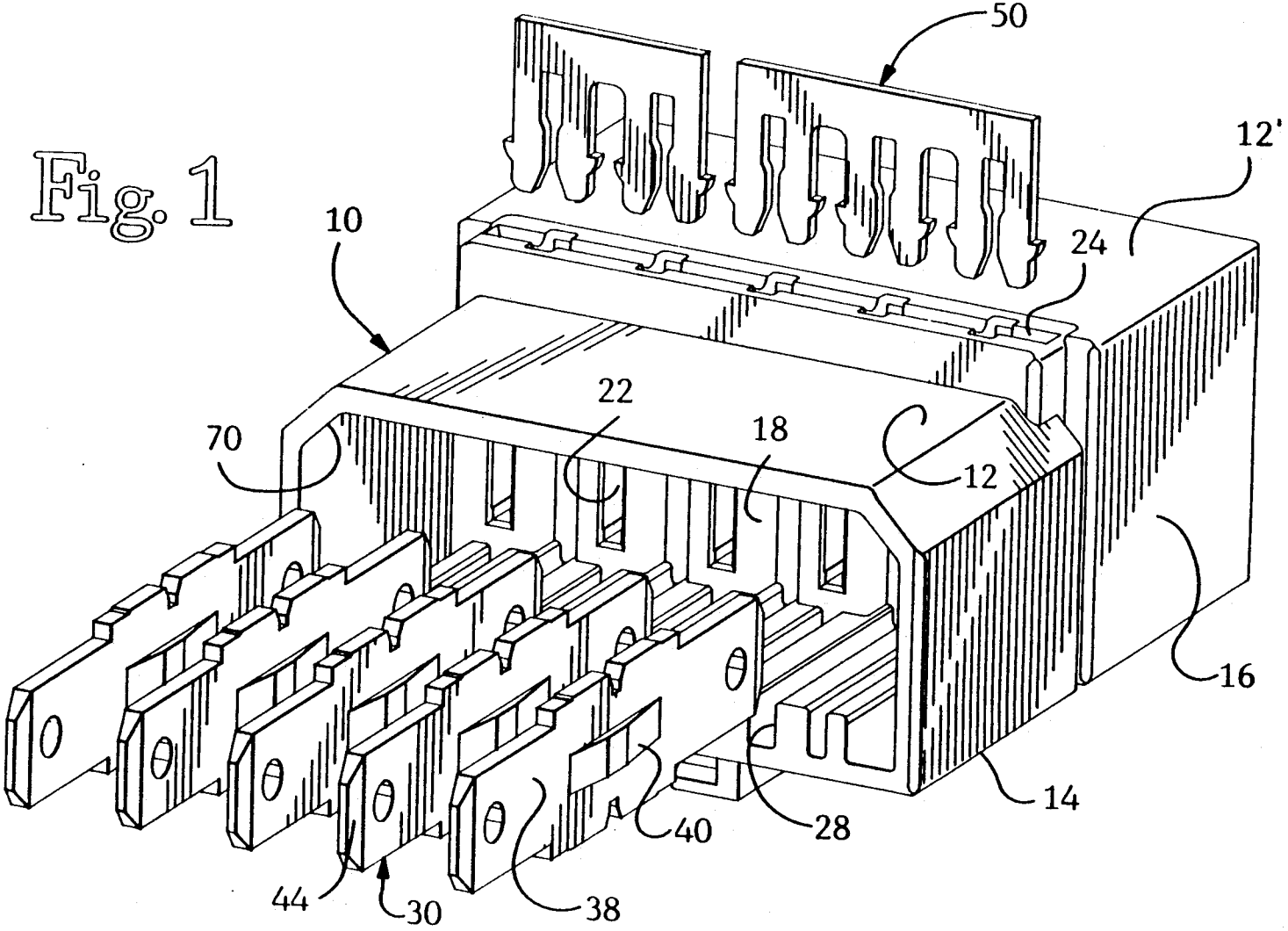
FIG. 1 is an exploded perspective view from a first open end of an exemplary electrical interconnection assembly according to this invention.
Figure 2:
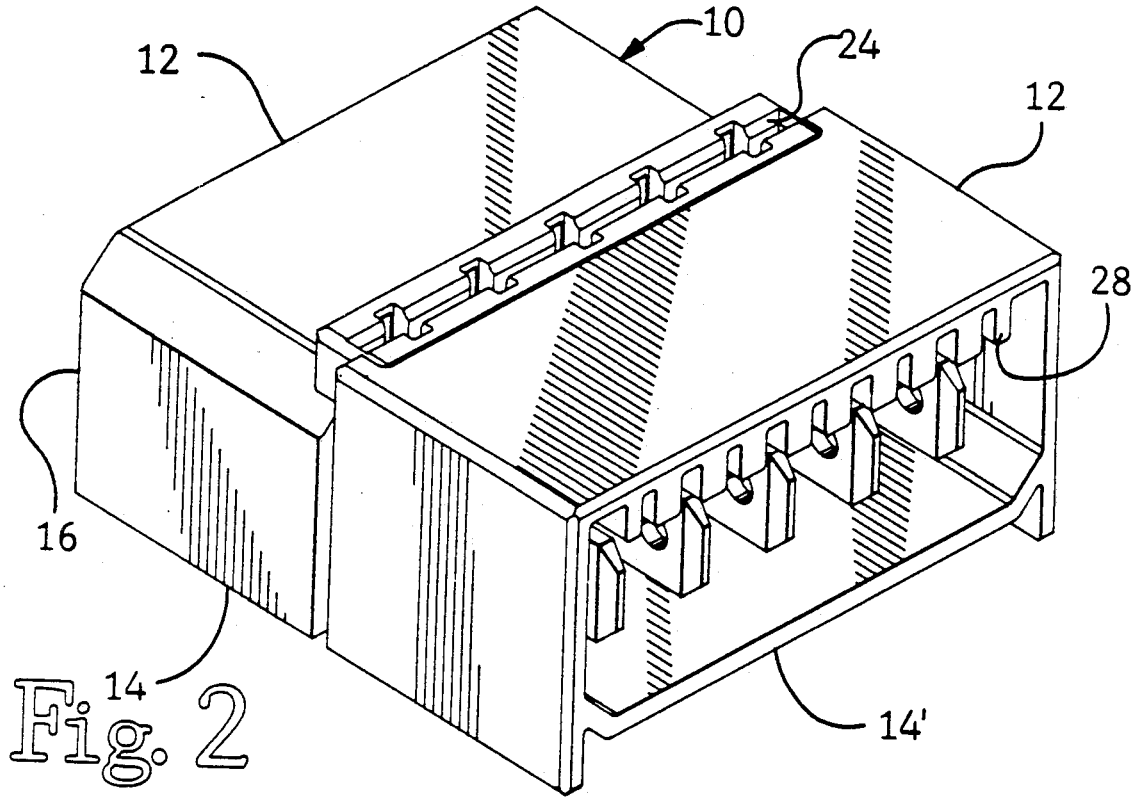
FIG. 2 is a perspective view of the assembled connection of FIG. 1, but illustrated from a second open end thereof.
Figure 3:
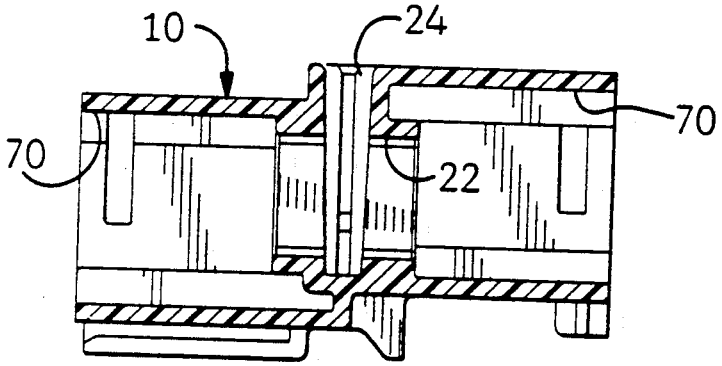
FIG. 3 is an axial, vertical sectional view of the assembly housing shown in FIG. 2.

Turning now to the electrical interconnection assembly of this invention in more detail, reference is made to FIGS. 1 and 2 wherein there is shown the major components thereof, respectively, unassembled and assembled. The housing 10 comprises a shell formed by a two tiered top 12,12', a two tiered bottom 14,14' and a pair of side walls 16 joined together. Internally, the housing 10 is provided with a central transverse partition or wall 18 containing a plurality of contact receiving slots 22. Each such slot is adapted to slidably receive and support a male contact member (FIGS. 1 and 6) in a manner more fully described hereinafter.

Figure 4:
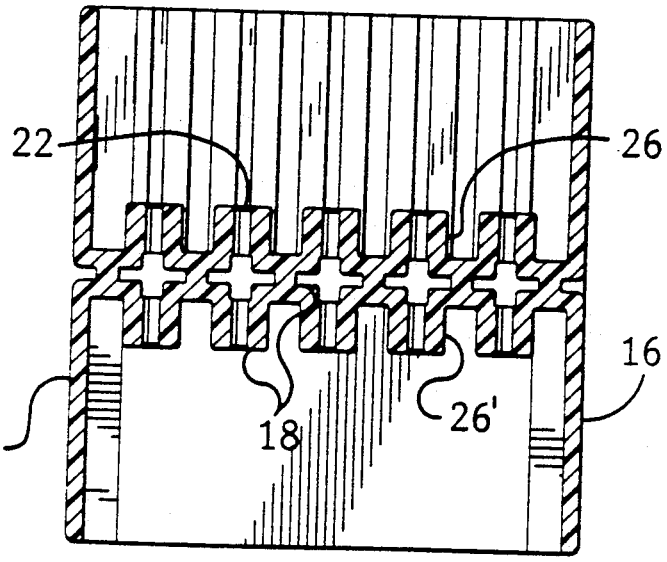
FIG. 4 is a horizontal sectional view of the assembly housing shown in FIG. 1.

A further feature of the housing 10 is the provision of a lateral slot 24, along the top wall 12', which slot communicates with the contact receiving slots 22 while dividing central wall 18 into essentially two parts 26,26' (FIG. 4). The function of the slot 24 will become more apparent hereinafter, where it will be noted that a transverse sectional view of the slot is configured to accept a contact locking and retaining member (FIGS. 1, 5, and 7).

A final feature of the housing, while forming no part of this invention, is the provision of a plurality of channels 28 internally along the bottom 14 or top 12'. The channels 28 may be provided to locate a part which locks into a hole in the bulkhead of an automobile, for example. Such channels, the purpose for which are well known, are a standard design in the French automotive industry and further discussion is deemed unnecessary.

In FIG. 6 there is illustrated an elongated planar contact member 30 for insertion and support in the housing 10 as noted above. The contact member 30 is characterized by oppositely disposed male tab ends 32, each of which are provided with a hole 34 which cooperates with a complementary female contact (not shown) to maintain contact therewith. Internally, the contact member 30 is provided with a pair of opposed, top and bottom, slots 36, 36'. In a manner to become apparent hereinafter, such slots 36, 36' cooperate with a transverse member (FIGS. 1, 5, and 7) which can be adapted to render common or place in parallel two or more adjacent contact members 30.

An optional feature of the contact member 30 is that along the middle thereof an indent is struck causing the side 38 to protrude 40, see FIG. 1. In contrast thereto, FIG. 6 shows a flat side 38 for the contact member 30. In either case, the slot 22 may be suitably dimensioned to slidably receive the contact member. For example, for the contact member 30 of FIG. 1, it may be desirable to alter the dimensions of slot 22, such as the use of a broader midsection, to accommodate the central portion of the contact member where the indent is struck.

Finally, the tab ends 32 are tapered 44, both along the edges and major faces thereof, to facilitate the tabs entry into a complementary female contact (not shown). Reference is made to U.S. Pat. No. 4,478,470, directed to an electrical contact suitable for mating with said tabs. As described therein, means may be provided within the tab receiving portion of the contact for guiding the male tab into such portion. Additionally, a barb or projection is provided therein to engage the hole 34 of the male tab. Also means may be provided for shifting or moving of the hole engaging barb to allow for the withdrawal of the male tab mated with the female contact, as known in the art.

A third major component of the electrical interconnection assembly of this invention is exemplified by the slotted planar member 50 of FIG. 5. Such member may be stamped from a flat electrically conductive metal blank. The member 50 comprises two or more sections 52, having a plurality of slots 54,56, where adjacent slots are configured differently. The narrow slots 54 are each designed with opposing, inwardly directed projections 58 for slidably and snugly receiving a contact member 30, as best seen by the pre-engagement illustration of FIG. 7. The intermediate slots 56 are each provided with a wall engaging barb 60, the purpose of which is to engage or dig in to the internal wall 18 of housing assembly, see FIG. 7. Additionally, the ends of member 50, more particularly, each section thereof, are provided with barbs 62 to further aid in securing the planar member 50 within the housing assembly.

Figure 8A:
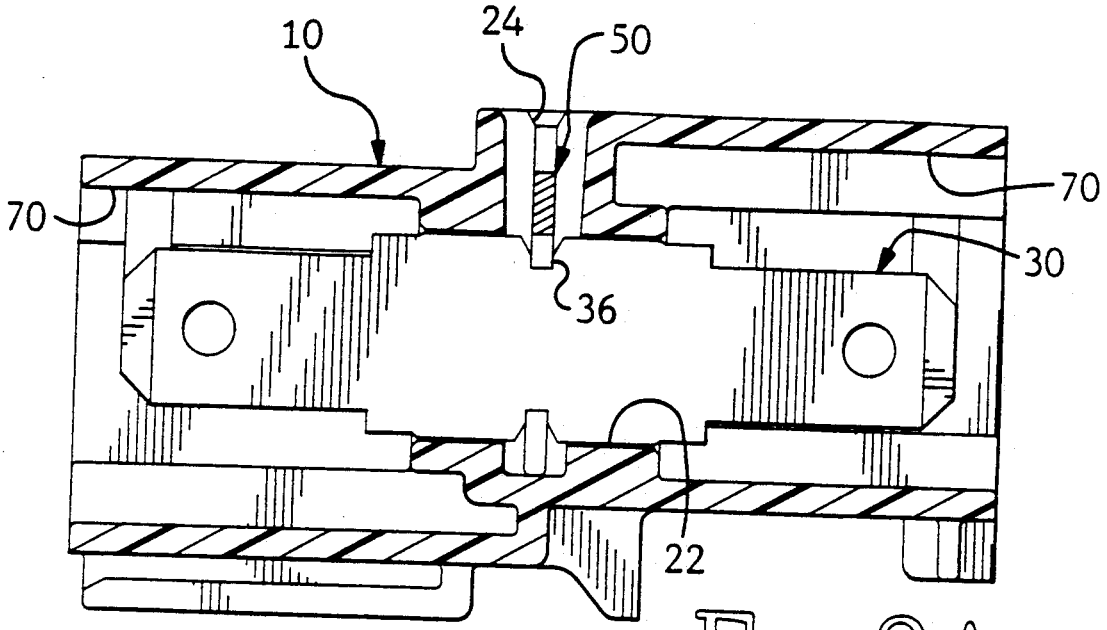
FIG. 8A and 8B, respectively, are axial, sectional views similar to FIG. 3, showing the positions of first insertion of the contact member, and locking said contact member within the housing assembly.
Figure 8B:
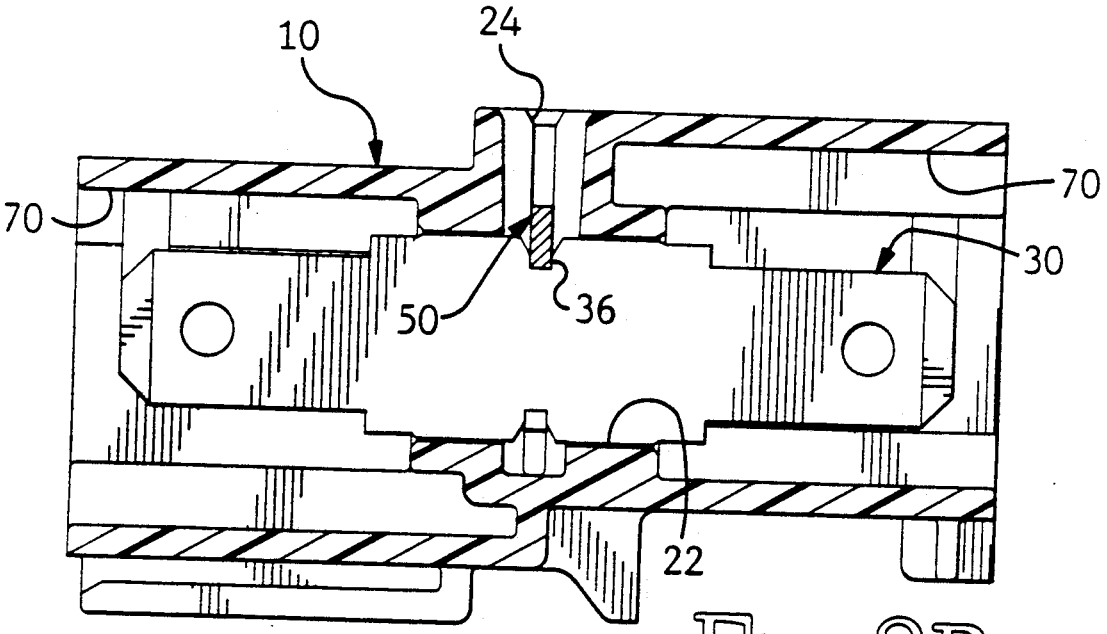

Turning now to the assembly of the electrical interconnection assembly of this invention, reference is made to FIGS. 8A and 8B. Initially, the contact members 30 are inserted into one of the mating ends 70 of the housing assembly 10 to be seated in appropriate slots 22. Thereafter, the member 50, typically plural members in end-to-end relationship, as shown in FIGS. 1, 5, and 7, is inserted into the housing 10 through slot 24 at least to a first depth (FIG. 8A). If each contact member 30 is properly seated and aligned, the planar member(s) is pushed deeper into the housing assembly. That is, if the slots 36 are in registry with the member 50, as shown in FIG. 8A, the member 50 may be pushed to a second depth (FIG. 8B) where slot 36 interlocks with the appropriate closed end 72 of a slot 54. By this arrangement, the contact member 30 is securely held within the housing 10. Such an assembly, as shown in FIG. 2, is ready for installation in a wall or bulkhead, as desired, and appropriately mated by complementary electrical connectors from each end thereof.

The number of post positions, five shown in FIG. 2, is limited primarily by the length of the connector in its intended use, and by the mating and unmating forces needed to effect use thereof. Accordingly, a reasonable number of positions is considered to be no more than about twelve. However, this number offers ample flexibility in programming possibilities in rendering common a number of different but adjacent contacts.

I claim:

1. An electrical interconnection assembly comprising a housing having an array of electrical contact members therein, said contacts arranged for exposure to opposed openings in said housing, whereby electrical connection may be made therewith, where said contacts are elongated members having male tabs at each end thereof and disposed in parallel relationship within said housing, and including means for electrically engaging certain adjacent elongated contact members, characterized in that said means comprise a plurality of laterally disposed planar members accessible to said array of contact members through a lateral slot in a wall of said housing, and that each said planar member includes a slot for slidably receiving one elongated member, and means adapted to engage a wall of said housing to secure said elongated contact members from premature withdrawal from said housing.

2. The electrical interconnection assembly according to claim 1 wherein said last named means comprise outwardly projecting barbs adapted to dig into a wall of said housing.

* * * * *